US007901129B2

(12) United States Patent
Bertrand et al.

(10) Patent No.: US 7,901,129 B2
(45) Date of Patent: Mar. 8, 2011

(54) SEALED WRIST WATCH CASE

(75) Inventors: Jean-Louis Bertrand, Feigeres (FR); William Passaquin, Armoy (FR)

(73) Assignee: Rolex S.A., Geneva (CH)

( * ) Notice: Subject to any disclaimer, the term of this patent is extended or adjusted under 35 U.S.C. 154(b) by 193 days.

(21) Appl. No.: 12/164,864

(22) Filed: Jun. 30, 2008

(65) Prior Publication Data

US 2009/0010111 A1 Jan. 8, 2009

(30) Foreign Application Priority Data

Jul. 2, 2007 (EP) ..... 07405187

(51) Int. Cl.
*G04B 37/22* (2006.01)
*G04B 37/00* (2006.01)

(52) U.S. Cl. ..... 368/286; 368/280; 368/276; 368/281; 368/291; 368/294; 368/297; 368/299; 368/88

(58) Field of Classification Search ..... 368/287, 368/291, 88, 276, 280, 294, 296, 297, 298, 368/299
See application file for complete search history.

(56) References Cited

U.S. PATENT DOCUMENTS 4,558,956 A * 12/1985 Bettschen ..... 368/291
4,620,798 A 11/1986 Scarinzi
4,674,892 A 6/1987 Loth
6,116,774 A 9/2000 Sasaki et al.
6,406,178 B1 * 6/2002 Luscher et al. ..... 368/286

FOREIGN PATENT DOCUMENTS

| | | | |
|---|---|---|---|
| CH | 343 949 | A | 12/1959 |
| CH | 336 866 | D | 10/1967 |
| CH | 690 870 | A5 | 2/2001 |
| EP | 0 853 094 | A | 7/1998 |
| GB | 1 240 239 | A | 7/1971 |

OTHER PUBLICATIONS

European Search Report No. EP 07 40 5187 dated Oct. 30, 2007.

* cited by examiner

*Primary Examiner* — Renee Luebke
*Assistant Examiner* — Jason Collins
(74) *Attorney, Agent, or Firm* — Westerman, Hattori, Daniels & Adrian, LLP

(57) ABSTRACT

This watch case comprises a protective casing surrounded by a middle (5) and a bezel (9). The protective casing includes a glass (3), a side wall (2) and a bottom (1). A planar peripheral surface extending along the entire edge of the inner face of the glass is in contact with a similar bearing surface on the side wall (2), at least part of which forms the width of the cross section of a pressure resistant structure having parallel lateral faces (SR) perpendicular to the bearing surface, and which extends without a gap as far as the bottom (1) of the casing. The components of the casing are secured and sealed with at least one annular seal (4) surrounding the lateral face of the glass (3) and the outer lateral face of the side wall (2) of the casing, and this seal is clamped.

27 Claims, 4 Drawing Sheets

SEALED WRIST WATCH CASE

The present invention relates to a sealed wrist watch case comprising a protective casing surrounded by a middle and a bezel.

A sealed watch case intended for depths greater than 300 meters and consisting of a middle-cum-bezel and a bottom made of a material less strong than steel, which has an interior dome made of a high mechanical strength material which fits the inner face of the bottom and at least partially fits the inner wall of the middle-cum-bezel and bears via its edge against the side of a shoulder of the middle-cum-bezel opposite the side on which the glass bears, has already been proposed by CH 690 870.

This solution has two weak points which limit the depth that can be tolerated by the sealed case: firstly, the presence of a shoulder on the middle made of a material of lower mechanical strength and arranged between the glass and the interior dome, which would be crushed under a pressure exceeding the elastic limit of the material of the middle-cum-bezel; the second weak point is due to the fact that the portion of the dome bearing against the shoulder of the middle-cum-bezel projects from the wall of the dome, creating poor conditions for transferring the compressive force exerted on the dome.

The document mentions that the case having a dome made of titanium 3 mm thick can reach a depth of a thousand meters. The presence of the shoulder on the middle held between the glass and the interior dome would, however, not make it possible to descend much deeper without risking permanent crushing of this shoulder.

A sealed watch case of which the body is at least partly made of plastic and part of which surrounds the rim of the glass is described in CH 343 949. A middle-cum-bezel surrounds the plastic case body and has a frustoconical interior shoulder acting on the part of the plastic case body surrounding the rim of the glass in such a way that when the bottom is screwed on it exerts axial traction on the middle-cum-bezel, by virtue of which traction the part of the case body is elastically deformed due to the axial pressure exerted thereon.

That document still includes a case body made at least partly of compressible material. It does not therefore include a casing having a pressure resistant structure since it is designed specifically to deform under a force of axial traction exerted on the case body, unlike a normal watch case.

The ability to deform required in CH 343 949 as a result of an axial force being exerted on the plastic case body is therefore intended for a purpose opposite to that of the present invention.

The object of the present invention is to overcome the limitations of the prior art solutions while limiting the increase in the thickness of a sealed wrist watch case which is able to tolerate a predetermined pressure.

The problem which occurs when making a sealed wrist watch case which is resistant down to very great depths, typically of between 3000 and 5000 meters, is in particular its thickness. Sealed wrist watch cases are known which are resistant to pressures of around 10 to 15 MPa, corresponding respectively to depths of 1000 and 1500 meters. These cases are already around 14.5 mm thick which is already relatively thick for a wrist watch. In order to be resistant to pressures 3 to 4 times greater, the thickness of such a case would have to be increased by more than 5 mm, which presents problems for a wrist watch. Above a certain thickness, every extra millimeter is a millimeter too much.

For this reason, the subject of the present invention is a sealed wrist watch case comprising a protective casing surrounded by a middle and a bezel, according to claim 1.

The main advantage of this sealed watch case is that it can tolerate pressures of several tens of MPa with substantially less of an increase in thickness compared to conventional watch cases, this allowing a watch case to be produced which can tolerate depths of several thousand meters, typically between 3000 and 5000 meters, and the thickness of which allows it to be worn as a wrist watch. Since the bezel and the middle do not protect the movement of the watch which is entirely protected by the protective casing, they can be made of the same material as is traditionally used for watch cases, ranging from plastic to platinum via stainless steel and the various alloys of gold.

Another advantage of the invention is that the sealing and the pressure resistance are obtained from completely different components which have no influence whatsoever on each other. By contrast, the sealing members are involved in the assembly of at least some components of the protective casing.

The attached drawings illustrate schematically and by way of example an embodiment and two variants of a sealed wrist watch case according to the present invention.

In the figures:

FIG. 1 shows a watch case according to the prior art. This watch case has been chosen because it is a commercially available sealed wrist watch case, tested to 1550 meters, which makes it a wrist watch that is resistant to great depths.

Figure 1:
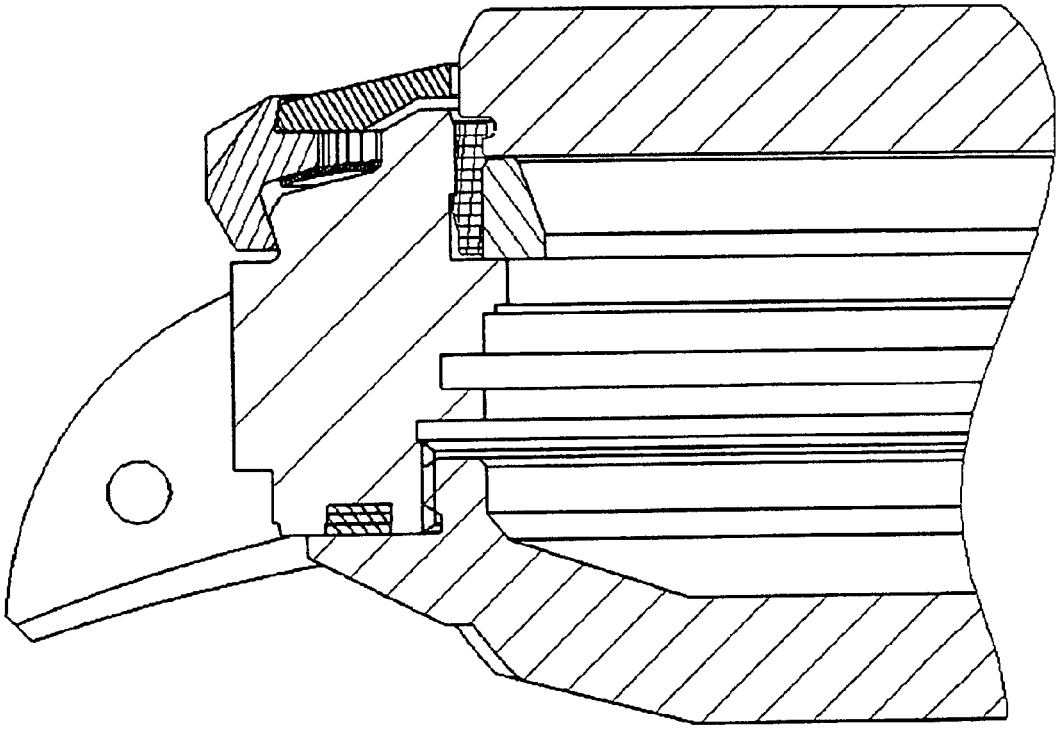
FIG. 1 PRIOR ART
FIG. 1 shows a vertical cross section through a watch case according to the prior art.

When consideration was given to making a watch case resistant to pressures of around 50 MPa, it was found that the conventional sealed watch case, such as that illustrated in FIG. 1, would lead to a case thickness close to 20 mm and this would be barely acceptable for a wrist watch.

Figure 2:
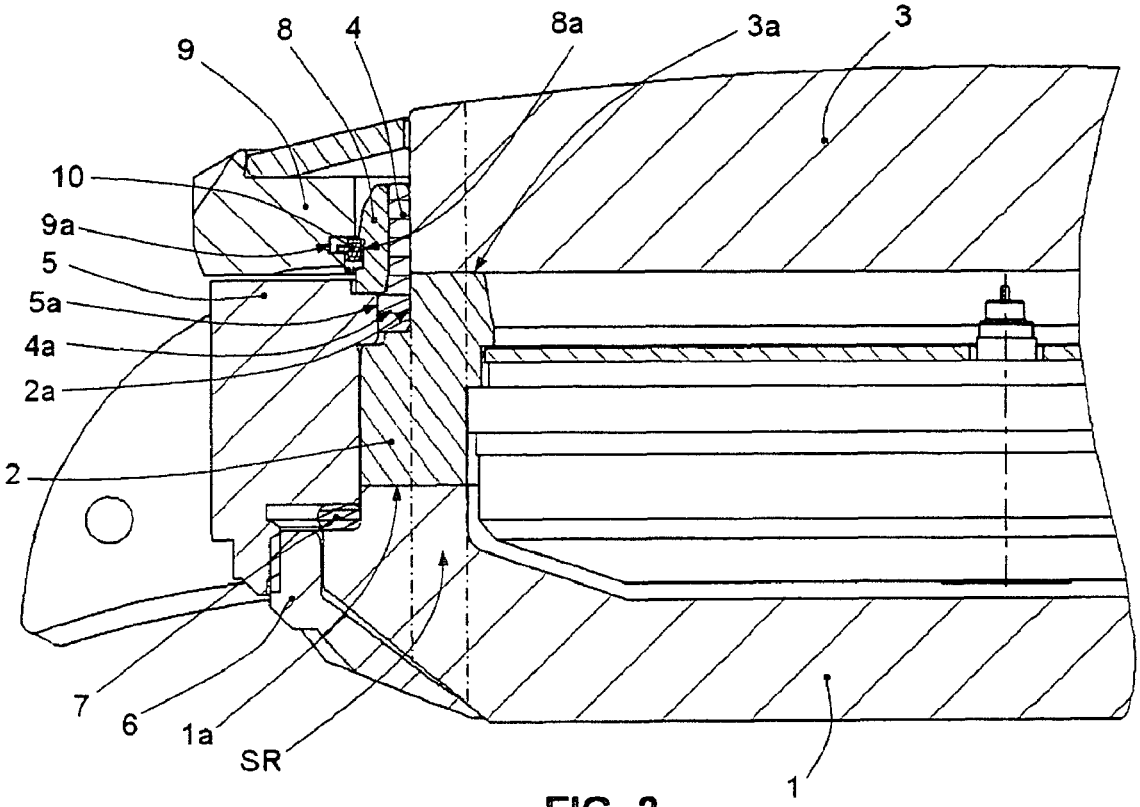
FIG. 2 shows a vertical cross section through the embodiment of the sealed wrist watch case according to the invention.

The wrist watch case of the present invention and illustrated in FIG. 2 includes an entirely closed protective casing which comprises in this embodiment a bottom 1 made of a material having a Young's modulus sufficient to limit deformation. It will be seen in the following that this Young's modulus must be >100 000 MPa. The flexural strength of this material must in particular be substantially greater than that of the two traditional materials, stainless steel and gold. In the example illustrated, this material could be a ceramic such as zirconia. The material could also be titanium which in particular has a high flexural strength and a Young's modulus >100 000 MPa.

This bottom 1 has an arcuate profile which improves its flexural strength. At its edge there is a planar surface 1*a* on which a side wall 2 rests which is made of a material the compressive strength of which is substantially greater than that of stainless steel or gold. Given that this side wall 2 must be perforated to allow the passage of the winding stem, a metal-ceramic alloy is preferred. An alloy such as a nickel-free steel of the Biodur 108 type can be used, the properties of which are shown in table II.

This side wall 2 is defined by two planar surfaces, one in contact with the surface 1*a* of the bottom 1 and the other in contact with a planar surface 3*a* of the periphery of the glass 3, which is made of sapphire having an appropriate Young's modulus and flexural strength as shown in table I.

The protective casing formed here by the bottom 1, the side wall 2 and the glass 3 includes a pressure resistant structure SR having parallel lateral faces perpendicular to the bearing surfaces between this side wall 2 and the bottom 1, on the one hand, and between this side wall 2 and the glass 3, on the other, and which extends without a gap as far as the bottom 1 of the casing and overlaps at least part of the side wall 2 and the bottom 1 of the casing. This pressure resistant structure SR is defined in FIGS. 2 to 4 by two dot-dash lines. As will be seen in table III, the compressive strength of this side wall 2 can be modified by adjusting the radial thickness of the resistant structure SR.

The side wall 2 has an outer side wall 2*a* situated in the extension of the lateral surface of the glass 3, the cross sections defined by these lateral surfaces being constant. These two lateral surfaces are surrounded by an annular seal 4. The base 4*a* of this seal 4 is compressed in the radial direction by an inner lateral surface part 5*a* of a middle 5 surrounding the side wall 2 of the protective casing. An inner shoulder provided between the inner lateral surface part 5*a* of the middle 5 and the rest of this lateral surface surrounding the side wall 2 abuts against an outer shoulder of this side wall 2.

The part of the middle 5 situated at the bottom 1 of the protective casing has a thread for receiving a threaded clamp ring 6 between the middle 5 and the bottom 1. A seal 7 is arranged between an outer shoulder of the bottom 1 and the base of the middle 5.

The part of the annular seal 4 which surrounds the lateral face of the glass 3 is compressed in the radial direction by a clamp ring 8, preferably made of titanium. Thus, the annular seal 4 serves both as a seal between the glass 3 and the side wall 2 and for fixing these two pieces together. A bezel 9 is also fixed around the clamp ring 8 by a connecting ring 10 straddling an annular depression 8*a* in the clamp ring 8 and an annular groove 9*a* in the inner lateral face of the bezel 9.

This sealed mounting of the glass 3 by way of a ring compressed in the radial direction has the advantage of completely separating the compressive strength from the sealing function. Moreover, while a slight elastic compression of the side wall 2 occurs at very great depths, the annular seal 4 allows the glass to slide and to remain permanently in contact with the adjacent end of the side wall 2 of the protective casing.

Figure 3:
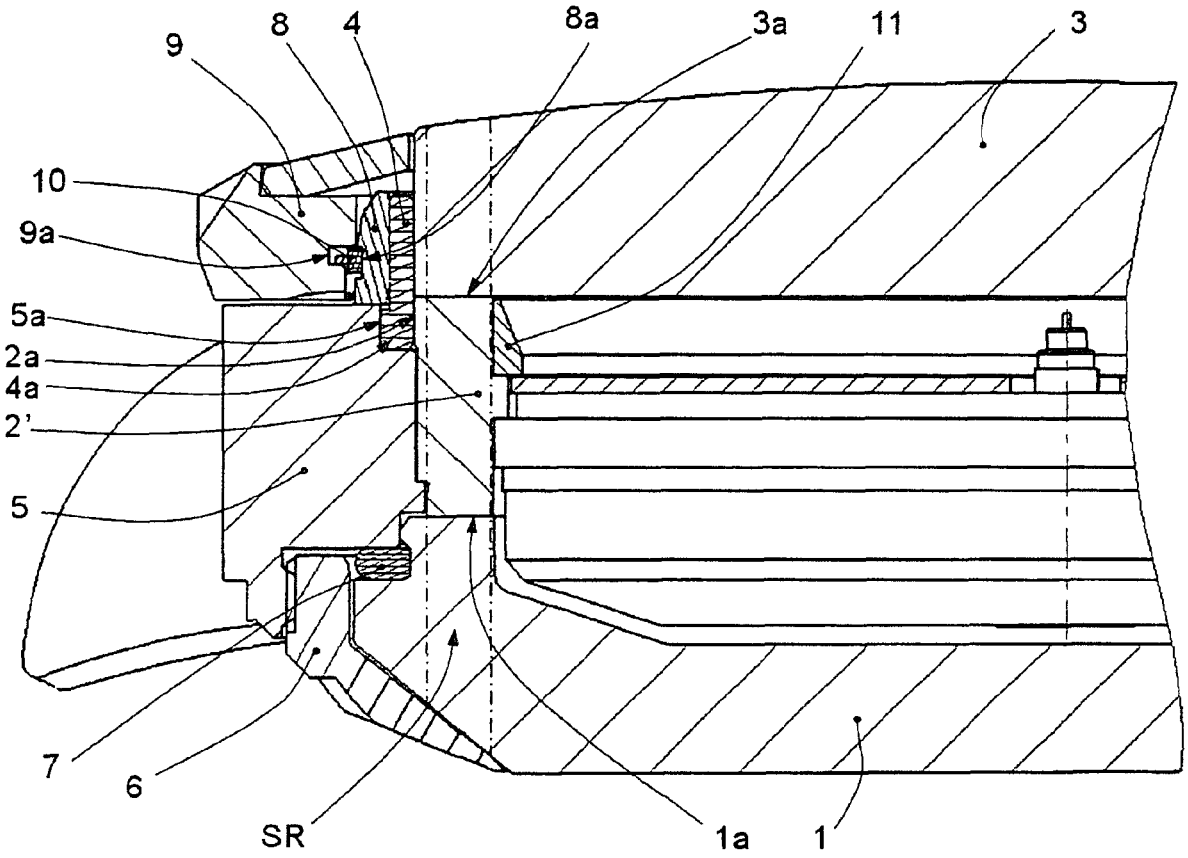
FIG. 3 shows a vertical cross section through a first variant of FIG. 2.

The variant of FIG. 3 differs essentially from the embodiment of FIG. 2 in that the side wall 2' is reduced mainly to the resistant structure SR, a flange 11 being attached to the inside of the side wall 2' instead of being integrated in the side wall 2 as in the example of FIG. 2.

Figure 4:
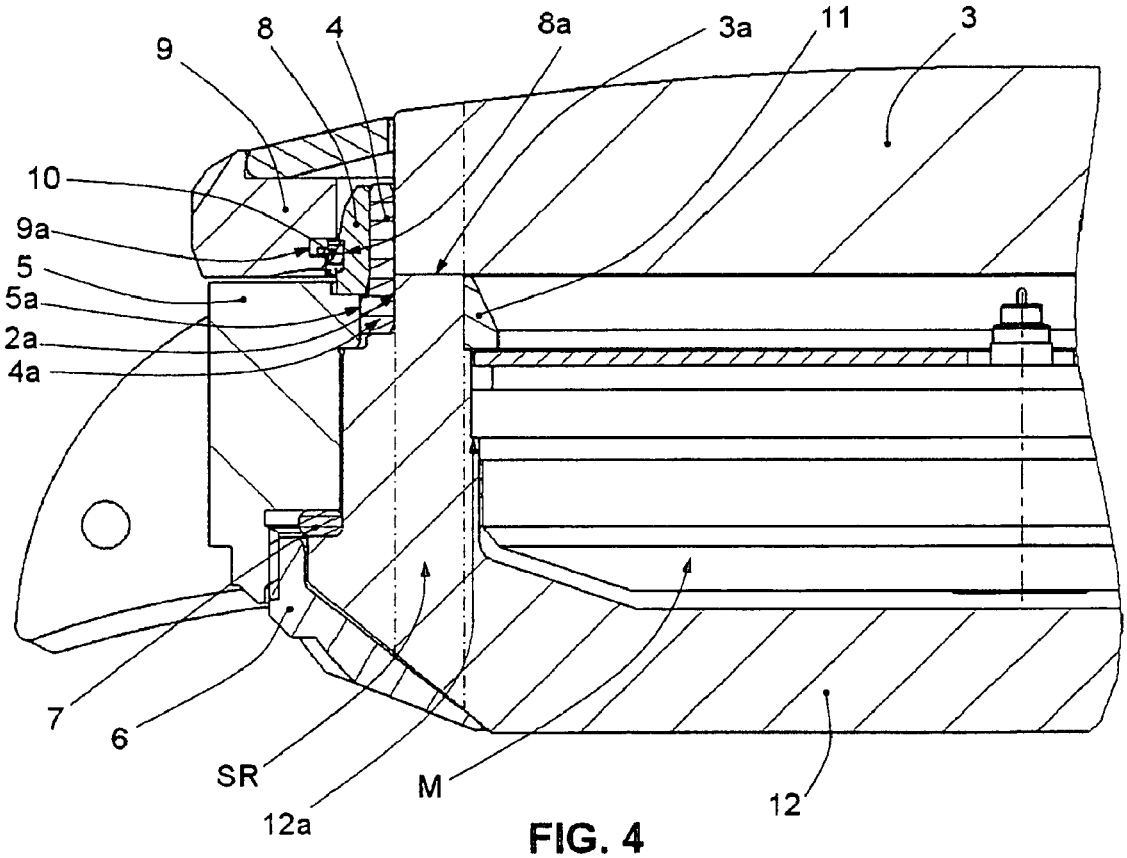
FIG. 4 shows a vertical cross section through a second variant of FIG. 2.

The second variant of FIG. 4 differs from FIGS. 2 and 3 mainly in that the side wall and the bottom form a single piece in the form of a cap 12 with a flange 11 attached in the same way as in FIG. 3. This flange 11 can serve to hold the movement M of the watch which can only be put in the case from above by bearing on a shoulder 12*a* of the inner lateral face of the side wall of the cap 12. The rest of the case is similar to the cases from FIGS. 2 and 3.

Combining the two pieces 1 and 2 into a single piece 12 currently causes a problem for manufacturing when this piece 12 is made of ceramic, given the perforation required for the passage of the winding stem.

It would not be possible to make the whole piece 12 from the alloy Biodur 108 used for the side wall alone in FIGS. 2 and 3 given that this material does not have sufficient flexural strength. By contrast, there is nothing to prevent this piece 12 being made from titanium because, as FIGS. 5 and 6 show, this material fulfills equally well the conditions of compressive strength required of the side wall and the conditions of flexural strength required of the glass or the bottom, as well as the relative conditions of Young's modulus, fixed so as to limit the deformation of the materials of the protective casing, which, if this deformation were excessive, would require increasing the thickness of the case, which is obviously not acceptable.

The following two tables summarize the conditions that the materials used for various components of the protective casing must satisfy in order to provide a watch case resistant to pressures of up to 50 MPa.

TABLE I

| | Glass and bottom | | | | |
|---|---|---|---|---|---|
| | Suitable materials | | | Unsuitable materials | |
| | | | | Stainless | Yellow |
| | Titanium TA6V grade 5 | Zirconia ($ZrO_2$) | Sapphire ($Al_2O_3$) | steel AISI 904L | gold 3N (Au 750) |
| Young's modulus (MPa) | 114 000 | 220 000 | 355 000 | 193 500 | 85 500 |
| Flexural strength (MPa) | 900 | 1400 | 570 | 250 | 350 |

TABLE II

| | Side wall | | | | | |
|---|---|---|---|---|---|---|
| | Suitable materials | | | | Unsuitable materials | |
| | | | | | | Yellow |
| | Titanium TA6V grade 5 | Biodur 108 | Zirconia ($ZrO_2$) | Sapphire ($Al_2O_3$) | Stainless steel AISI 904L | gold 3N (Au 750) |
| Young's modulus (MPa) | 114 000 | 195 000 | 220 000 | 355 000 | 193 500 | 85 500 |
| Compressive strength (MPa) | 1100 | 770 | 3000 | 2950 | 250 | 350 |

It can be seen from these tables and from simulations carried out on the basis of the values in these tables, that the lower limit that can be fixed for the Young's modulus is 100 000 MPa, while the flexural strength and compressive strength can each be fixed at 500 MPa.

The following table III is a comparative table relating to the dimensions of the wrist watch case, on the one hand according to the present invention and on the other according to the prior art case illustrated in FIG. 1.

TABLE III

| | Case according to the invention | | Case according to the prior art | |
|---|---|---|---|---|
| | 15.5 MPa pressure equiv. to 1550 m | 49 MPa pressure equiv. to 4900 m | 15.5 MPa pressure equiv. to 1550 m | 49 MPa pressure equiv. to 4900 m |
| Glass thickness | 2.8 mm | 5.5 mm | 3 mm | 5.7 mm |
| Bottom thickness | 1.8 mm | 3.28 mm | 2.55 mm | 5 mm |
| Side wall cross section (int. diam. 28.54 mm) | 5.76 mm × 0.80 mm | 5.76 mm × 1.48 mm | — | — |
| Total thickness of case | 13.5 mm | 17.68 mm | 14.52 mm | 19.7 mm |

It can be seen that at the same pressure of 49 MPa, the reduction in the thickness is 2.02 mm, or 10.25%. This comparison is of interest given that it was carried out on two sealed wrist watch cases for two identical watch movements M, which means that the 2.02 mm reduction in the thickness of the case is solely a result of the case concept according to the present invention.

This shows that, no matter what depth the sealed wrist watch case is intended to be resistant to, the structure of the case according to the invention allows the thickness to be reduced. Of course, the greater the depth the greater the reduction, but table III shows that this reduction is already virtually 1 mm at a pressure of 15.5 MPa.

The invention claimed is:

1. Sealed wrist watch case comprising:

a protective casing surrounded by a middle and a bezel, the protective casing including a glass, a bottom and a side ring, wherein the side ring has an upper surface bearing directly on a planar bearing surface of a peripheral surface of the inner face of the glass, wherein the protective casing includes a pressure resistant structure defined by (i) at least an annular portion of the planar bearing surface of the glass, said annular portion having a radial width, and (ii) at least an annular portion of the casing, said annular portion of the casing including an annular portion of the side ring and an annular portion of the bottom, said annular portion of the casing having a cross section in a radial plane, said cross section having (a) a radial width which is the same as the radial width of the annular portion of the planar bearing surface and (b) parallel lateral sides perpendicular to the bearing surface of the glass and extending without a gap from the glass to a lower face of the casing, and means for securing and sealing the glass, bottom and side ring of the casing, wherein the glass and the bottom are made of materials each having a Young's modulus >100 000 MPa and a flexural strength >500 MPa, and a material of the side ring has a Young's modulus >100 000 MPa and a compressive strength >500 MPa.

2. Sealed wrist watch case according to claim 1, in which the side ring and the bottom of the casing are in two pieces made of two different materials.

3. Wrist watch case according to claim 2, further comprising (i) a bottom seal provided between an outer shoulder of the bottom and a shoulder of the middle, and (ii) a bottom clamp ring including a screw thread in engagement with a screw thread of the middle, said bottom clamp ring comprising a bottom clamping surface oriented for axial clamping, said bottom clamping surface of the bottom clamp ring being in engagement with a corresponding surface on the bottom.

4. Wrist watch case according to claim 3, in which the glass is made of sapphire, the bottom is made of ceramic and the side ring is made of a metal or an alloy.

5. Wrist watch case according to claim 1, in which a material of the side ring has a Young's modulus >100 000 MPa and a compressive strength >500 MPa.

6. Watch case according to claim 1, in which materials of the glass and the bottom of the casing have a flexural strength >550 MPa and a material of the pressure resistant structure has a compressive strength >750 MPa.

7. Wrist watch case according to claim 1, having an overall thickness less than 17.7 mm and resistant to pressures up to 50 MPa.

8. Wrist watch case according to claim 1, in which the bottom and the side ring form a single piece.

9. Wrist watch case according to claim 8, in which the bottom and the side ring forming a single piece are made of titanium.

10. Sealed wrist watch case according to claim 1, in which the securing and sealing means comprise (i) at least one annular seal surrounding a portion of an outer lateral face of the glass and a portion of an outer lateral face of the side ring, and (ii) means for radially clamping the annular seal to the portion of the outer lateral face of the glass and to the portion of the outer lateral face of the side ring.

11. Sealed wrist watch case according to claim 10, wherein each of the portion of the outer lateral face of the glass and the portion of the outer lateral face of the side ring has a constant cross-section along an axis perpendicular to the bearing surface of the glass.

12. Wrist watch case according to claim 10, in which the means for radially clamping the annular seal comprise (i) an annular seal clamping surface secured to the middle so as to clamp part of the annular seal between the middle and the outer lateral face of the side ring, and (ii) an annular seal clamp ring, so as to clamp a different part of the annular seal between the annular seal clamp ring and the outer lateral surface of the glass.

13. Wrist watch case according to claim 10, in which the outer lateral face of the glass and the outer lateral face of the side ring are adjacent to one another and have identical cross-sections so as to form a continuous surface.

14. Wrist watch case according to claim 1, in which the pressure resistant structure is resistant down to depths in the range of from 3,000 to 5,000 meters.

15. Sealed wrist watch case comprising:

a protective casing surrounded by a middle and a bezel, the protective casing including a glass, a bottom and a side ring, wherein the side ring has an upper surface bearing directly on a planar bearing surface of a peripheral surface of the inner face of the glass, wherein the protective casing includes a pressure resistant structure defined by (i) at least an annular portion of the planar bearing surface of the glass, said annular portion having a radial width, and (ii) at least an annular portion of the casing, said annular portion of the casing including an annular portion of the side ring and an annular portion of the bottom, said annular portion of the casing having a cross section in a radial plane, said cross section having (a) a radial width which is the same as the radial width of the annular portion of the planar bearing surface and (b) parallel lateral sides perpendicular to the bearing surface of the glass and extending without a gap from the glass to a lower face of the casing, and means for securing and sealing the glass, bottom and side ring of the casing, wherein said securing and sealing means comprise (i) at least one annular seal surrounding a portion of an outer lateral face of the glass and a portion of an outer lateral face of the side ring, and (ii) means for radially clamping the annular seal to the portion of the outer lateral face of the glass and to the portion of the outer lateral face of the side ring.

16. Sealed wrist watch case according to claim 15, in which the side ring and the bottom of the casing are in two pieces made of two different materials.

17. Wrist watch case according to claim 16, further comprising (i) a bottom seal provided between an outer shoulder of the bottom and a shoulder of the middle, and (ii) a bottom clamp ring including a screw thread in engagement with a screw thread of the middle, said bottom clamp ring comprising a bottom clamping surface oriented for axial clamping, said bottom clamping surface of the bottom clamp ring being in engagement with a corresponding surface on the bottom.

18. Wrist watch case according to claim 17, in which the glass is made of sapphire, the bottom is made of ceramic and the side ring is made of a metal or an alloy.

19. Wrist watch case according to claim 15, in which a material of the side ring has a Young's modulus >100 000 MPa and a compressive strength >500 MPa.

20. Watch case according to claim 15, in which materials of the glass and the bottom of the casing have a flexural strength >550 MPa and a material of the pressure resistant structure has a compressive strength >750 MPa.

21. Wrist watch case according to claim 15, having an overall thickness less than 17.7 mm and resistant to pressures up to 50 MPa.

22. Wrist watch case according to claim 15, in which the bottom and the side ring form a single piece.

23. Wrist watch case according to claim 22, in which the bottom and the side ring forming a single piece are made of titanium.

24. Sealed wrist watch case according to claim 15, wherein each of the portion of the outer lateral face of the glass and the portion of the outer lateral face of the side ring has a constant cross-section along an axis perpendicular to the bearing surface of the glass.

25. Wrist watch case according to claim 15, in which the means for radially clamping the annular seal comprise (i) an annular seal clamping surface secured to the middle so as to clamp part of the annular seal between the middle and the outer lateral face of the side ring, and (ii) an annular seal clamp ring, so as to clamp a different part of the annular seal between the annular seal clamp ring and the outer lateral surface of the glass.

26. Wrist watch case according to claim 15, in which the outer lateral face of the glass and the outer lateral face of the side ring are adjacent to one another and have identical cross-sections so as to form a continuous surface.

27. Wrist watch case according to claim 15, in which the pressure resistant structure is resistant down to depths in the range of from 3,000 to 5,000 meters.

* * * * *